United States Patent [19]

Butcher

[11] Patent Number: 4,761,655

[45] Date of Patent: Aug. 2, 1988

[54] TRANSPORTABLE ANTENNA FOR AN EARTH STATION

[75] Inventor: Miles E. Butcher, Woodbridge, England

[73] Assignee: British Telecommunications plc, London, England

[21] Appl. No.: 802,965

[22] Filed: Nov. 29, 1985

[30] Foreign Application Priority Data

Nov. 30, 1984 [GB] United Kingdom ..... 8430306

[51] Int. Cl.[4] ..... H01Q 3/08; H01Q 15/16

[52] U.S. Cl. ..... 343/713; 343/765; 343/840; 343/882; 343/916

[58] Field of Search ..... 343/711, 840, 912, 713, 343/914–916, 880–882, 757, 735

[56] References Cited

U.S. PATENT DOCUMENTS

| | | | |
|---|---|---|---|
| 2,181,181 | 11/1939 | Gerhard | 343/916 |
| 2,413,558 | 12/1946 | DeWitt | 343/840 |
| 3,377,595 | 4/1968 | Carr et al. | 343/713 |
| 3,392,397 | 7/1968 | Schwartz | 343/840 |
| 3,714,660 | 1/1973 | Scrafford et al. | 343/882 |
| 3,717,879 | 2/1973 | Ganssle | 343/915 |

FOREIGN PATENT DOCUMENTS

| | | | |
|---|---|---|---|
| 2850492 | 5/1979 | Fed. Rep. of Germany | 343/840 |
| 2359547 | 2/1978 | France . | |
| 144234 | 12/1978 | Japan | 343/840 |
| 42420 | 3/1980 | Japan | 343/840 |
| 663166 | 12/1951 | United Kingdom . | |
| 1196857 | 7/1970 | United Kingdom . | |
| 1219872 | 1/1971 | United Kingdom | 343/786 |
| 2154067 | 8/1985 | United Kingdom . | |

OTHER PUBLICATIONS

Patents Abstracts of Japan, vol. 7, No. 204 (E-197) (1349) 9th Sep. 1983, & JP-A-58 101 507.

*Primary Examiner*—William L. Sikes
*Assistant Examiner*—Michael C. Wimer
*Attorney, Agent, or Firm*—Nixon & Vanderhye

[57] ABSTRACT

The antenna (e.g., a transportable, lightweight and cheap antenna for temporary earth stations) is constructed out of three components. The center component is a circular/parabolic dish. The side components extend the dish to give the composite a major diameter and a minor diameter. In use the antenna is aligned so that the major diameter is aligned with the direction of the geostationary arc.

6 Claims, 2 Drawing Sheets

TRANSPORTABLE ANTENNA FOR AN EARTH STATION

FIELD OF THE INVENTION

This invention relates to antennas and particularly, but not exclusively, to transportable antennas for earth stations (e.g. an antenna). In particular it relates to an antenna which is of a size suitable for mounting on a vehicle and it combines this small size with adequate directional properties for satellite communication. In addition the manufacturing cost is low.

BACKGROUND OF THE INVENTION

The increasing use of satellite communications gives rise to a need for earth stations which can be moved to a location which has a temporary requirement for telecommunications services and especially a need for high volume or world wide services. Examples of such a requirement include conferences which may produce a temporary increase in the demand for telephone and data services and sporting events which may produce a demand for TV transmission. It is often convenient to provide these services by means of a temporary ground station assembled on or near the location of the meeting or event. The antenna is a major item in a ground station and it is important to have an antenna which is easily conveyed via public roads.

Because it is intended for temporary use, it is probable that such an antenna will be used for only a small percentage of its lifetime and, therefore, a low cost construction is important. Nevertheless when used in the transmit mode the antenna should not cause interference to other services.

SUMMARY OF THE INVENTION

According to this invention an antenna comprises a reflector formed of three components, said three components being a circular dish which is a paraboloid of revolution and two side components in contact with the center dish and diametrically opposite one another, said side components extending the paraboloid of revolution to change the aperture of the antenna by extending one diameter thereof.

In this specification the term "diameter" is used in relation to the aperture of the antenna and it denotes a straight line from a point on the boundary of the aperture, through the boresight and extended to the point on the opposite side of the boundary. Since the boundary is not circular there will be a shortest diameter, hereinafter called the minor diameter, and a longest diameter, hereinafter called the major diameter.

The ratio:

(major diameter):(minor diameter)

will be called the "aspect ratio" of the antenna. Aspect ratios above 1.1 especially in the range 1.1 to 1.5, e.g. 1.2 to 1.4 are particularly suitable. It is preferred that the major diameter be perpendicular to the minor diameter. In most constructions it is convenient for the center component, considered in isolation, to have a circular aperture and it is also convenient for the minor diameter of the whole antenna to be equal to the diameter of the center component.

The side components increase the aspect ratio to values above 1. This increase causes the composite antenna, in comparison to the center component, to have a narrower far field radiation pattern, both as regards the main lobe and the envelope containing the side lobes. For electrical reasons it is usually undesirable to utilize a major diameter as high as 4 focal lengths and values below 3.8 focal lengths are preferred. It is also desirable to utilize a minor diameter in the range 2.0 to 3.5 focal lengths, preferably in the range 2.4 to 3.0 focal lengths. The preferred focal lengths are in the range 1 m to 2.5 m, e.g. to 1.5 m.

Since the side components serve to extend the major diameter of the aperture, the shape of the side components is determined by the shape of the desired aperture. Each side component has an inner boundary which is in contact with the center dish. It is clearly necessary that the inner boundary conform to the shape of the periphery of the dish. The other part of the boundary of a side component constitutes the boundary of the aperture of the antenna. The aperture of the antenna can be determined by conventional methods, e.g. an elliptical aperture can be used, and the aperture of the antenna defines the other part of the boundary of a side component. As indicated above, the antennas may be transportable for use in an earth station but they may also be used in fixed installations and/or for terrestrial system applications.

In order to meet, as far as possible, the conflicting requirements of low manufacturing cost, ease of transport and adequate electrical properties, a preferred arrangement provides side components wherein each has an outer boundary (which preferably is a segment of a circle in a plane perpendicular to the boresight) an inner boundary (which conforms to the periphery of the dish) and two side boundaries which join the ends of the outer boundary to the ends of the inner boundary. It is particularly convenient for the side boundaries to be planar curves normal to the outer boundary.

It is important for the primary feed to conform to the usual feed requirements, i.e. it should substantially irradiate the whole reflector, substantially all the radiation should impinge on the reflector and it should have a small cross sectional area to minimize blocking. A circular waveguide is satisfactory but a choke flange feed gives better performance.

The antenna according to the invention is preferably permanently mounted on a road vehicle, e.g. a trailer. It is convenient to use the trailer to convey other equipment for a small earth station, e.g. transmitting and receiving equipment and electrical power generators.

To prepare the antenna for use three angular adjustments are required and the preferred mounting on the trailer provides these. Two of these requirements correspond to the conventional rotation about horizontal and vertical axes whereby the boresight of the antenna can be directed at the satellite. It is also desirable to align the major diameter of the aperture so that it is parallel to the earth's equatorial plane; rotation about the boresight of the antenna permits this. (Rotation about a vertical axis is provided, in whole or part, by movement of the whole trailer).

BRIEF DESCRIPTION OF THE DRAWINGS

One embodiment of the invention will now be described by way of example with reference to the accompanying drawings in which.

DETAILED DESCRIPTION

Figure 1:
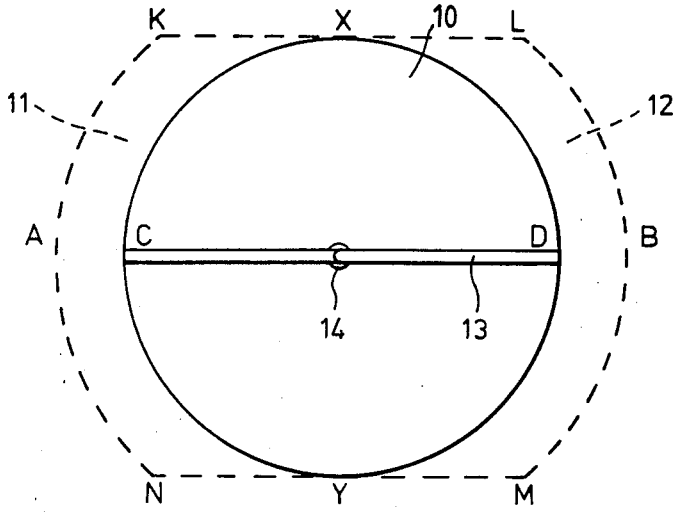
FIG. 1 is front view of an antenna according to the invention.
Figure 2:
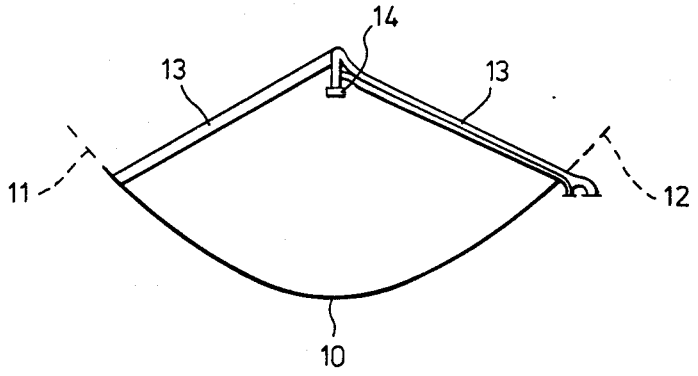
FIG. 2 is cross section of the antenna of FIG. 1.

As can be seen from FIGS. 1 and 2 the antenna is composed of three main components, namely a center component 10 and two side components 11 and 12. The center component is a dish having the shape of a paraboloid of revolution and, by itself, it constitutes a front fed antenna with a bridge 13 to support a feed 14, e.g., a choke flange feed. In the example shown in FIG. 2 one leg of the bridge is formed from a pair of waveguides, which each excite independently one sense of polarization in the feed.

Each side component 11 and 12 has an annular shape in the projected aperture plane so that each fits onto the center component 10. Components 11 and 12 are diametrically opposite one another. The side components are also shaped to continue the parabolic surface of revolution of the center component 10. The major diameter of the composite antenna is 4.8 m and the minor diameter is 3.7 m, in the particular example shown.

The addition of the side components 11 and 12 enhances the performance of the center dish so that it is acceptable for use as a temporary earth station. In addition the composite is cheap, light and of dimensions which permit transport over the public roads.

In FIG. 1 the periphery of the complete composite has been labelled AKXLBMYN. X and Y mark the extremities of the minor diameter and XY is also a diameter of the center dish. A and B mark the extremities of the major diameter. The plane of FIG. 1 is normal to the boresight.

Segments KXL and NYM lie in planes normal to the plane of FIG. 1 and they are shown as their projections (which are straight lines). These two segments are parabolas with vertices at X and Y. Segments NAK and LBM are segments of a common circle and they both lie in the plane of FIG. 1.

The center component 10 has circular periphery which lies in a plane behind that of FIG. 1. This periphery is marked XDYC. One of the side components has periphery AKXCYN and the other side component has periphery BLXDYM.

Figure 4:
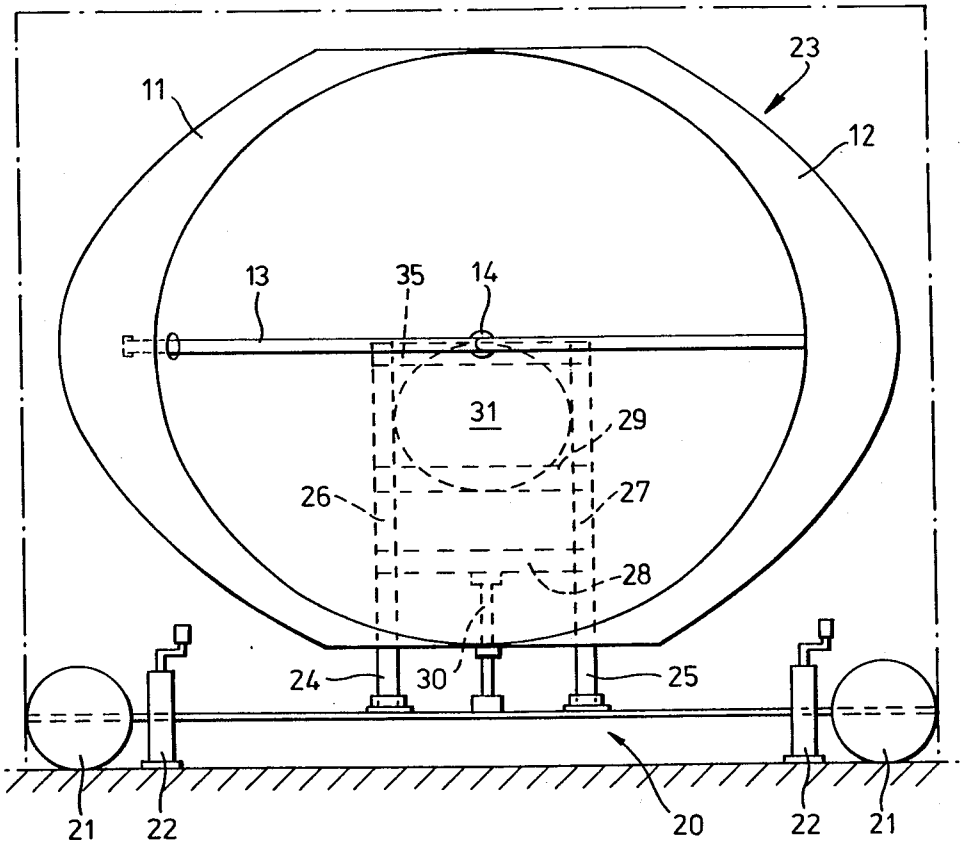
FIG. 4 is a side view of FIG. 3.
Figure 3:
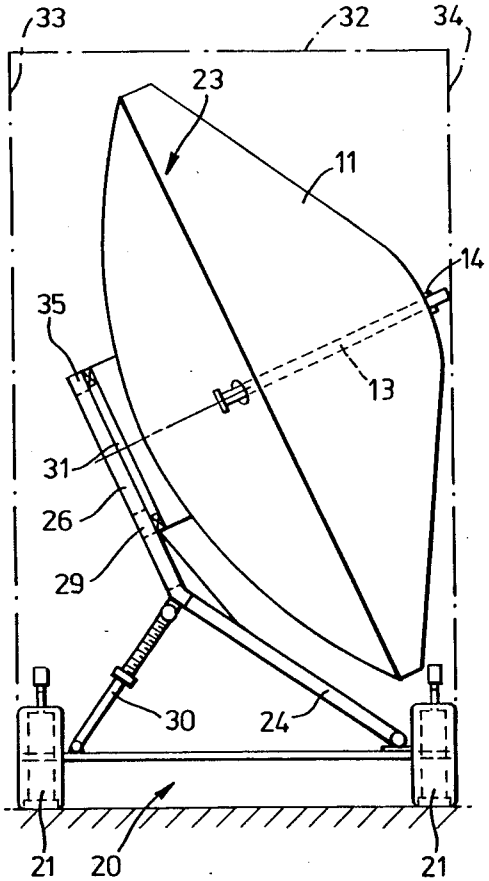
FIG. 3 is a front view of the antenna of FIGS. 1 and 2 mounted on a trailer.

FIGS. 3 and 4 show the composite antenna (indicated by 23 in FIGS. 3 and 4) mounted on a trailer and in the configuration for transport. For transport, the trailer is attached to a towing vehicle (not shown) which is detached for other employment while the earth station is in use.

The trailer (indicated schematically) 20 has wheels 21 for transport and jacks 22 to provide stability during use. The antenna is supported on a frame comprising front legs 24 and 25 which extend as struts 26 and 27 inclined at an angle of 150° to legs 24 and 25. Struts 26 and 27 are connected by cross-braces 28 and 29. The frame also includes an extensible leg 30 connected to the mid point of cross brace 28. A turn-table 31 is secured to cross-brace 27 and 28 and also to struts 26 and 27. The axis of rotation of the turn table is parallel to (or coincident with) the axis of revolution of the circular dish 10 and the boresight of antenna 23 as shown in FIG 3.

In the position for transport the major diameter of the aperture is aligned parallel to the longitudinal axis of the trailer 20 and the extensible leg 30 is adjusted so that all of the antenna 23 lies within height and width limits indicated by dotted lines in FIG. 3. The height limit 32 is 4.3 m above the ground and the width limits 33, 34 are 2.4 m apart. Thus, in its transportable configuration, the antenna 23 and its trailer 20 are convenient for passage over public roads including the passage of obstructions such as bridges.

It is emphasized that the antenna, including the bridge 13 and feed 14, remains intact during transport. When it arrives at a site the antenna needs to be connected to radio equipment and it also needs to be pointed correctly but there is no need for assembly because it is already intact. The pointing of the antenna is carried out as follows. First, the trailer 20 as a whole is aligned so that its longitudinal axis is perpendicular to the straight line between the target satellite (which is on the geosynchronous arc) and antenna 23. When the orientation of the trailer is satisfactory then the jacks 22 are lowered to stabilize (and incidentally immobilize) the trailer 20. Second, the extensible leg 30 is adjusted until the boresight of the antenna is aligned with the target satellite. These two adjustments correspond to the conventional pointing of an antenna. Finally, the turn table 31 is rotated to adjust the antenna 23 so that the aperture has its major diameter parallel to the earth's equatorial plane.

The final adjustment is needed because the antenna has a non-uniform field. The angular spread of energy is greater in the direction of the aperture's minor diameter than in the direction of its major diameter. When it is used in the transmit mode it is important that the direction of greater spread be aligned perpendicular to the geosynchronous arc. This has the effect that the narrower pattern illuminates the geosynchronous arc whereby the level of irradiation of other satellites, residing at different but nearby longitudinal locations on said arc, is minimized.

In a modification not shown in any drawing the frame is rotatable through small azimuth angles on the trailer in order to facilitate fine adjustment of the antenna. It will be appreciated that lowering the jacks 22 to stabilize the trailer also immobilizes it. Rotation of the antenna relative to the trailer is necessary if it is intended to adjust the bearing of the antenna relative to the trailer is necessary if it is intended to adjust the bearing of the antenna after stabilization.

What is claimed is:

1. A transportable antenna suitable for satellite communication comprising a non-circular reflector formed of three components wherein:

one of the components is a center component including a circular dish having an axis of revolution and having the shape of a parabolic surface of revolution, and the other two components are side components being located adjacent with the dish and diametrically opposite one another, each of said side components having as peripheral portion which is in contact with the center component along half of the periphery of the center component, said side components being shaped to extend the parabolic surface of revolution of the dish, thereby defining a reflector whose outer boundary is not circular and whose side components are not hingedly connected to said center component.

2. An antenna according to claim 1 wherein the aspect ratio, i.e., the ratio of the reflector major diameter to its minor diameter, is in the range 1.2 to 1.5.

3. An antenna according to claim 1 or 2, wherein each side component has an aperture defined by four boundary curves wherein said four curves include:

(a) an inner boundary which is in contact with and half of the periphery of the center component;

(b) an outer boundary which is a segment of a circle in a plane perpendicular to the axis of revolution of the center component of the antenna; and (c) two side boundaries each connecting an end of the inner boundary to an end of the outer boundary.

4. An antenna according to claim 3, wherein each side boundary is a segment of a parabola in a plane normal to the outer boundary.

5. An antenna according to claim 1, wherein the feed includes a choke flange feed.

6. A transportable antenna suitable for satellite Communication comprising a non-circular reflector formed of three components wherein:

one of the components is a center component including a circular dish having an axis of revolution and having the shape of a parabolic surface of revolution, and the other two components are side components being located adjacent with the dish and diametrically opposite one another, each of said side components having a peripheral portion which is in contact with the center component along half of the periphery of the center component, said side components being shaped to extend the parabolic surface of revolution of the dish, thereby defining a reflector whose outer boundary is not circular and whose side components are not hingedly connected to said center component and, wherein said reflector has a major diameter and a minor diameter, said antenna being pivotally mounted on a trailer for both transport and use, wherein said pivotal mounting includes means for providing vertically movement of the antenna to facilitate alignment with a target satellite and means for rotation of the antenna about an axis parallel to the axis of revolution of said dish to permit alignment of the major diameter parallel to the earth's equatorial plane.

* * * * *